US006447985B1

(12) United States Patent
Thomas

(10) Patent No.: US 6,447,985 B1
(45) Date of Patent: Sep. 10, 2002

(54) SOLUTION TO ACCELERATE THE BLEACHING OF A COLOR PHOTOGRAPHIC PRODUCT

(75) Inventor: Francoise M. Thomas, Chalon-sur-Saone (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/705,303

(22) Filed: Nov. 3, 2000

(30) Foreign Application Priority Data

Nov. 12, 1999 (FR) ..... 99 14473

(51) Int. Cl.[7] ..... G03C 5/40; G03C 7/392
(52) U.S. Cl. ..... 430/449
(58) Field of Search ..... 430/449

(56) References Cited

U.S. PATENT DOCUMENTS 4,506,007 A 3/1985 Nakajima et al. ..... 430/393
4,588,471 A * 5/1986 Griffith et al. ..... 156/652
4,666,212 A * 5/1987 Loveday et al. ..... 299/5
4,913,787 A * 4/1990 Kiso ..... 204/44.3
4,959,278 A * 9/1990 Shimauchi et al. ..... 428/642

FOREIGN PATENT DOCUMENTS

| | | |
|---|---|---|
| EP | 678 783 | 4/1995 |
| EP | 679 945 | 4/1995 |
| JP | 51/95630 | 8/1978 |

* cited by examiner

*Primary Examiner*—Hoa Van Le
(74) *Attorney, Agent, or Firm*—Andrew J. Anderson

(57) ABSTRACT

This invention concerns a new processing solution to accelerate the bleaching of a color photographic product. This invention further concerns a method for the processing of a photographic product that uses such a solution to accelerate the bleaching process.

The invention makes available a new solution to accelerate bleaching with improved efficacy.

12 Claims, No Drawings

SOLUTION TO ACCELERATE THE BLEACHING OF A COLOR PHOTOGRAPHIC PRODUCT

FIELD OF THE INVENTION

This invention concerns a new processing solution to accelerate the bleaching of a color photographic product. This invention further concerns a processing method for a photographic solution that makes use of such a solution to accelerate bleaching.

BACKGROUND OF THE INVENTION

Conventionally the processing of color photographic products comprises a color developing step, a bleaching step, a fixing step, a final rinsing step, one or more washing steps and a drying step. In some processes the fixing and bleaching steps are combined using a single bleaching-fixing solution.

During photographic developing, the exposed silver halides contained in the photographic product are reduced to metallic silver by a developer. The oxidized developer then reacts with a dye-forming coupler to form a color image. Once this image is formed the silver contained in the photographic product has to be removed. To remove this silver the product is first bleached in a bleaching solution, which converts the metallic silver into silver halides. The photographic product is then fixed with a fixing solution containing a silver halide solvent.

Despite these bleaching and fixing steps the silver contained in the photographic product is never completely eliminated. The photographic product, after treatment, contains a residual amount of silver that impairs color rendition, in particular causing color desaturation.

This problem is especially important when photographic product contains large amounts of silver. The processing of such products, especially the removal of the silver halides, requires longer processing times and (or) higher temperatures.

With some bleaching processes, especially persulfate bleaching processes, a bleach accelerator is required. The bleach accelerator is adsorbed on the grains and acts as an electron transfer agent in the oxidation reaction of bleaching.

Persulfate bleaching is especially advantageous in processing because it is cheap and environmentally safe. It also favors the elimination of dyes, thereby reducing the residual dye stain on the processed photographic products.

It is therefore particularly desirable to have a new solution to accelerate bleaching with greater efficacy. In particular it is desirable to have a solution that when combined with a persulfate bleaching solution allows the residual silver concentration in color photographic solutions to be greatly reduced.

SUMMARY OF THE INVENTION

This invention concerns a processing solution to accelerate the bleaching of a color photographic product, that contains no bleaching agent, that contains a bleach accelerator, and that has a pH less than or equal to 3.

DETAILED DESCRIPTION OF THE INVENTION

In the scope of this invention the bleach accelerator is a compound that is adsorbed on the silver halide grains and favors the action of the bleaching agent by reducing the electron density at the surface of the silver grains. Such compounds are known as electron transfer agents.

According to one embodiment of the invention the bleach accelerator is a thiol compound or a thiol precursor.

A useful thiol compound is an aliphatic compound with formula RSH wherein R is preferably an aminoalkyl group. Useful thiol compounds are described in *Research Disclosure*, August 1981, n° 20821.

According to one embodiment the thiol compound has the formula:

where $R^1$ and $R^2$ are independently a hydrogen atom, an alkyl group containing 1 to 10

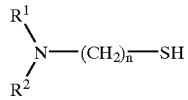

carbon atoms, preferably 1 to 4 carbon atoms, and n is between 1 and 4.

A useful thiol precursor is a compound that is modified during the processing of a photographic product to yield a compound having at least one SH function.

According to a preferred embodiment, the bleach accelerator is an isothiourea compound. These compounds preferably have the following formula:

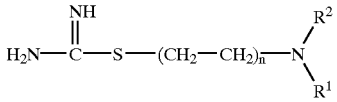

where $R^1$, $R^2$ and n are as defined above.

The quantity of bleach accelerator is at least 0.2 g/l, preferably between 0.2 and 5 g/l, and preferably between 0.6 and 4 g/l.

The pH of the bleach accelerator solution is preferably in the range of from 2 to 3.

This invention further concerns a processing method for a silver halide color photographic material that includes a step wherein the bleaching of the photographic material is accelerated, and a step wherein the photographic material is bleached, and wherein the bleach acceleration step is performed using the solution described above. In this method, the bleach acceleration step is distinct from the bleaching step.

According to a specific embodiment the bleach step is performed with a bleaching solution containing persulfate.

Conventionally, the processing of color photographic materials requires a color developing bath, a bleach accelerator, a bleaching bath and a fixing bath (or a single combined bleaching-fixing bath). The processing methods can include intermediate baths such as washing baths and stop baths. All these baths are described in detail in *Research Disclosure*, September 1996, No. 38957, sections XIX and XX.

According to one embodiment, the method of the invention is used for the processing of cinematographic films, for example a processing method such as that described in "Manual for Processing Eastman Color Films, Module 9, process ECP-2A and ECP-2B specifications". Preferably, the processing method of the invention is a method wherein the bleach solution contains persulfate as a bleaching agent.

The color photographic materials that can be processed using the method of this invention are conventional color photographic materials comprising a support coated with one or more layers of silver halide emulsion and one or more additional layers. These photographic materials are described in detail in *Research Disclosure*, sections I to XVII.

The invention is described in detail in the following examples.

EXAMPLES

Example 1

A color cinematographic film, Vision Color Premier, marketed by Eastman Kodak, having a silver content of about 2.3 g/m$^2$ was exposed through a 21 step tablet wedge, with an increment of 0.15 log E to incident light of color temperature 2850° K. through a C1700 filter for 1/100 s. The film was then developed using the conventional Kodak ECP-2B process as described in the manual H24 (Manual for processing Eastman Color Films, module 9), wherein the bleaching step is performed using a solution of persulfate containing 30 g/l of sodium persulfate.

A first sample was processed with the bleach acceleration solution specified in the manual. This solution consisted of:

| | |
|---|---|
| $H_2O$ | 800 ml |
| Anhydrous sodium metabisulfite | 3.3 g |
| Acetic acid (90%) | 6.25 ml |
| Accelerator PBA-1 | 3.3 g |
| EDTA | 0.5 g |
| $H_2O$ | QSP 1 liter |
| Ph | 4 |

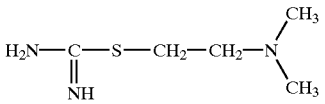

PBA-1

The processing conditions are given in Table 1.

After processing, the quantity of residual silver in the film was measured. This silver content was measured by infrared spectrophotometry at 900 nm from a calibration curve. The results are given in Table 1 below.

Example 2

A second sample of Vision Color Premier® film was processed with the same processing solutions as in example 1, but in the treatment conditions given in Table 1 below. After processing, the quantity of residual silver was measured. The results are given in Table 1 below.

Example 3

In this example the Vision Color Premier® photographic material was exposed and developed in the same conditions as in example 1. In this example, the bleach accelerator was modified, and consisted of:

| | |
|---|---|
| $H_20$ | 800 ml |
| Anhydrous sodium metabisulfite | 3.3 g |
| Sodium dihydrogen phosphate | 7 g |
| Phosphoric acid (85%) | 2.65 ml |
| PBA-1 accelerator | 3.3 g |
| EDTA | 0.5 g |

-continued

| | |
|---|---|
| $H_20$ | QSP 1 liter |
| pH | 3 |

The conditions of processing are given in Table 1.

After processing, the quantity of residual silver was measured by infrared spectrophotometry at 900 nm from a calibration curve. The results are given in Table 1 below.

Example 4

A second sample of Vision Color Premier® film was processed with processing solutions identical to those in example 3, but in different conditions given in Table 1 below. After processing, the quantity of silver was measured. The results are given in Table 1 below.

TABLE 1

| | Accelerator treatment time | Bleaching treatment time | Bleach temperature | Residual silver (mg/dm$^2$) |
|---|---|---|---|---|
| Ex. 1 | 20 s | 40 s | 27° C. | 0.219 |
| Ex. 2 | 12 s | 24 s | 27° C. | 3.27 |
| Ex. 3 | 12 s | 24 s | 27° C. | 0.21 |
| Ex. 4 | 12 s | 24 s | 20° C. | 0.83 |

It is known that a photographic material is considered as correctly bleached when its residual silver content is less than or equal to 0.8 mg/dm$^2$.

These results show that when the solution of the invention is used as a bleach accelerator the residual silver content is greatly reduced even when the bleach acceleration and bleaching times are shortened (Ex. 1 and Ex. 3).

Example 2 shows that when the treatment time is reduced without modifying the pH the residual silver level is unacceptable.

Example 4 shows that the bleach accelerator solution of the invention remains efficacious at reduced processing times and lower temperatures.

These examples show that lowering the pH affords bleach accelerator solutions that make the bleaching step particularly efficacious.

The invention has been described in detail with particular reference to certain preferred embodiments thereof, but it will be understood that variations and modifications can be effected within the spirit and scope of the invention.

What is claimed is:

1. A processing solution to accelerate the bleaching of a color photographic material, that contains no bleaching agent, and that contains a bleach accelerator, wherein the pH of the solution is less than or equal to 3 and the bleach accelerator is an isothiourea of the formula:

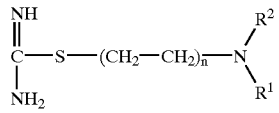

where $R^1$ and $R^2$ are independently a hydrogen atom or an alkyl group containing from 1 to 10 carbon atoms, and n is between 1 and 4.

2. The processing solution of claim 1, wherein the quantity of bleach accelerator is at least 0.2 g/l.

3. The processing solution of claim 1, wherein the pH is in the range of from 2 to 3.

4. A method for processing a silver halide color photographic material, that includes a step of bleach acceleration of the photographic material and a step of bleaching the photographic material, wherein (i) the bleach acceleration step is separate from the bleaching step, (ii) the bleaching step is carried out with a bleaching solution containing a persulfate, and (iii) the bleach acceleration step is carried out with a solution of claim 1.

5. The method of claim 4, wherein the bleach acceleration step is carried out with a solution having a pH in the range of from 2 to 3.

6. The processing solution of claim 1, wherein the bleach accelerator has the formula

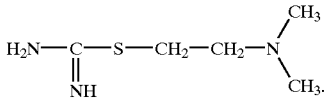

7. The processing solution of claim 6, which contains an amount of the bleach accelerator between 0.2 and 5 g/l.

8. The processing solution of claim 7, which contains 3.3 g/l of the bleach accelerator, 3.3 g/l of anhydrous sodium metabisulfite, 7 g/l of sodiumdihydrogenophosphate, 2.65 ml/l of 85% phosphoric acid, and 0.5 g/l of EDTA.

9. The method of claim 4, wherein the quantity of bleach accelerator in the bleach accelerator processing solution is at least 0.2 g/l.

10. The method of claim 4, wherein the bleach accelerator has the formula

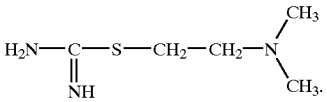

11. The method of claim 10, wherein the bleach accelerator processing solution contains an amount of the bleach accelerator between 0.2 and 5 g/l.

12. The method of claim 11, wherein the bleach accelerator processing solution contains 3.3 g/l of the bleach accelerator, 3.3 g/l of anhydrous sodium metabisulfite, 7 g/l of sodiumdihydrogenophosphate, 2.65 ml/l of 85% phosphoric acid, and 0.5 g/l of EDTA.

* * * * *